US011835894B2

(12) United States Patent
Sugaya

(10) Patent No.: US 11,835,894 B2
(45) Date of Patent: Dec. 5, 2023

(54) IMAGE FORMING APPARATUS THAT CHANGES DISCHARGE CONVEYANCE SPEED ACCORDING TO A DISTANCE BETWEEN A SHEET OR IMAGE LEADING EDGE AND A NIP PORTION

(71) Applicant: CANON KABUSHIKI KAISHA, Tokyo (JP)

(72) Inventor: Hajime Sugaya, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 11 days.

(21) Appl. No.: 17/392,387

(22) Filed: Aug. 3, 2021

(65) Prior Publication Data

US 2022/0050411 A1 Feb. 17, 2022

(30) Foreign Application Priority Data

Aug. 11, 2020 (JP) ..... 2020-135963

(51) Int. Cl.
*G03G 15/20* (2006.01)

(52) U.S. Cl.
CPC . *G03G 15/205* (2013.01); *G03G 2215/00413* (2013.01); *G03G 2215/00552* (2013.01); *G03G 2215/00945* (2013.01); *G03G 2215/00949* (2013.01)

(58) Field of Classification Search
CPC ..... G03G 15/205; G03G 2215/00413; G03G 2215/00552; G03G 2215/00945; G03G 2215/00949; G03G 15/657; G03G 15/70
See application file for complete search history.

(56) References Cited

U.S. PATENT DOCUMENTS

| | | | | |
|---|---|---|---|---|
| 5,532,793 | A * | 7/1996 | Kogure | G03G 15/234 271/301 |
| 7,945,180 | B2 * | 5/2011 | Kitami | G03G 15/6573 399/400 |
| 9,014,580 | B2 * | 4/2015 | Kasai | G03G 15/6585 399/45 |
| 9,709,939 | B2 | 7/2017 | Matsumoto | |
| 10,268,143 | B2 * | 4/2019 | Tanaka | G03G 15/1615 |
| 2015/0139675 | A1 * | 5/2015 | Maruyoshi | G03G 15/2028 399/68 |

FOREIGN PATENT DOCUMENTS

| | | | |
|---|---|---|---|
| JP | H04235574 | A | 8/1992 |
| JP | H05188678 | A | 7/1993 |
| JP | H07134519 | A | 5/1995 |
| JP | 2006065016 | A | 3/2006 |
| JP | 2015210433 | A | 11/2015 |

* cited by examiner

*Primary Examiner* — Justin N Olamit
(74) *Attorney, Agent, or Firm* — ROSSI, KIMMS & McDOWELL LLP

(57) ABSTRACT

An image forming apparatus includes a control unit configured to execute a sheet discharge mode. If a case where a distance between the leading edge and the nip portion is a first distance is a first case, and a case where a distance between the leading edge of the sheet and the nip portion is a second distance shorter than the first distance and the temperature detected by the temperature detection unit is the same as that in the first case is a second case, the control unit is configured to set a conveyance speed of the sheet in discharging the sheet toward the nip portion in the second case to be slower than that in the first case, in the sheet discharge mode.

16 Claims, 9 Drawing Sheets

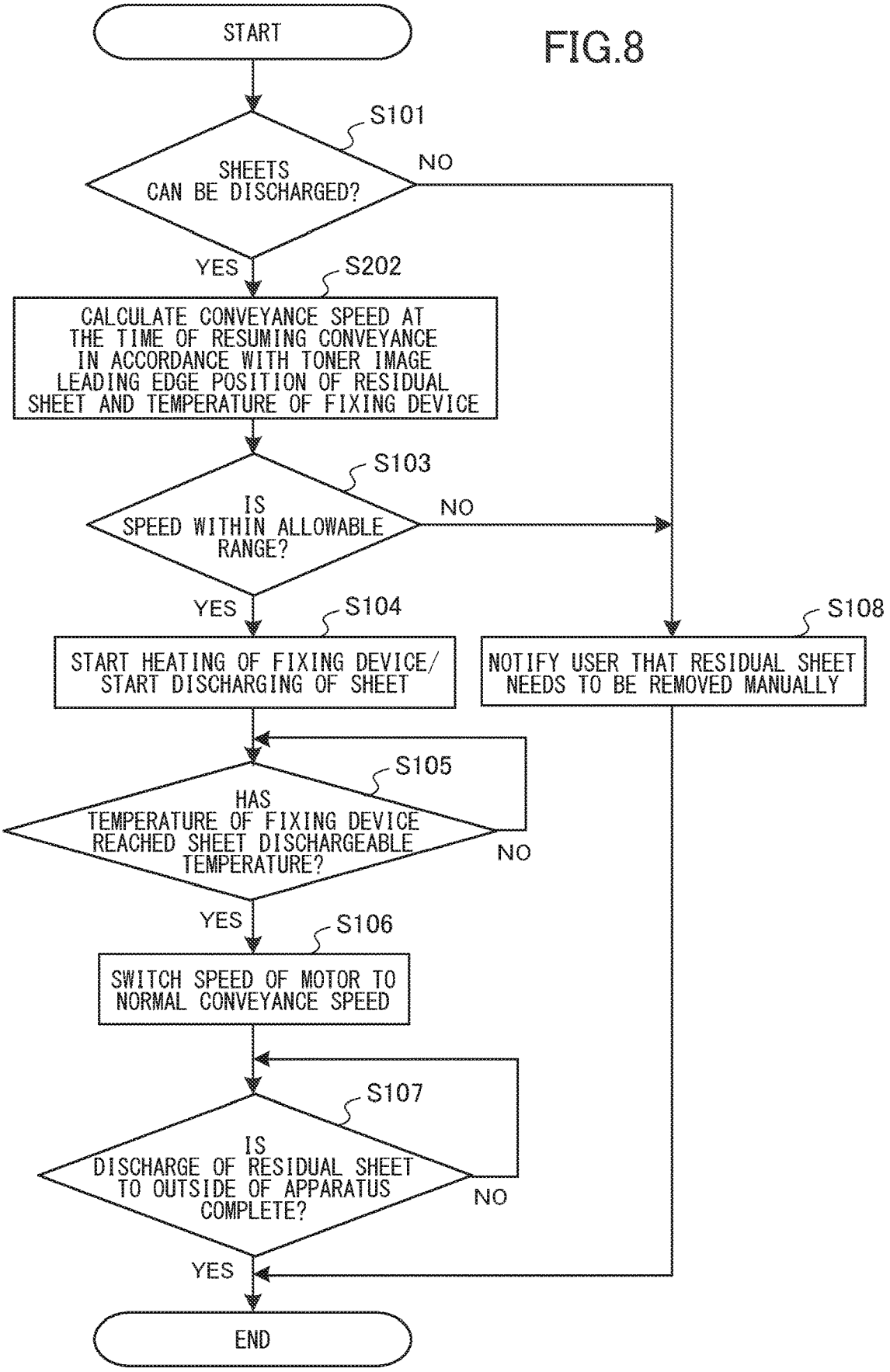
FIG.8
START
S101
SHEETS CAN BE DISCHARGED?
NO
YES
S202
CALCULATE CONVEYANCE SPEED AT THE TIME OF RESUMING CONVEYANCE IN ACCORDANCE WITH TONER IMAGE LEADING EDGE POSITION OF RESIDUAL SHEET AND TEMPERATURE OF FIXING DEVICE
S103
IS SPEED WITHIN ALLOWABLE RANGE?
NO
YES
S104
START HEATING OF FIXING DEVICE/ START DISCHARGING OF SHEET
S108
NOTIFY USER THAT RESIDUAL SHEET NEEDS TO BE REMOVED MANUALLY
S105
HAS TEMPERATURE OF FIXING DEVICE REACHED SHEET DISCHARGEABLE TEMPERATURE?
NO
YES
S106
SWITCH SPEED OF MOTOR TO NORMAL CONVEYANCE SPEED
S107
IS DISCHARGE OF RESIDUAL SHEET TO OUTSIDE OF APPARATUS COMPLETE?
NO
YES
END

IMAGE FORMING APPARATUS THAT CHANGES DISCHARGE CONVEYANCE SPEED ACCORDING TO A DISTANCE BETWEEN A SHEET OR IMAGE LEADING EDGE AND A NIP PORTION

BACKGROUND OF THE INVENTION

Field of the Invention

The present invention relates to an image forming apparatus that forms an image on a sheet.

Description of the Related Art

In general, an image forming apparatus such as a laser printer transfers a toner image formed on a photosensitive member to a sheet, and then heats and pressurizes the toner image on the sheet to fix the toner image to the sheet. In such an image forming apparatus, a phenomenon (hereinafter, also referred to as a jam) in which a sheet is stuck on a conveyance path may occur.

Hitherto, there has been disclosed an image forming apparatus that automatically discharges a sheet (residual sheet) remaining in the apparatus when a jam occurs (JP H04-235574 A and JP H07-134519 A). In the image forming apparatuses described in JP H04-235574 A and JP H07-134519 A, when a jam occurs, a fixing roller (heating roller) is heated to a predetermined temperature, and then conveyance of a sheet is started to discharge the sheet. As a result, in the image forming apparatus described in JP H04-235574 A and JP H07-134519 A, a matter which the sheet being conveyed before the fixing roller is sufficiently heated, the toner image not being fixed to the sheet, so that the toner adhering to the fixing roller is prevented.

On the other hand, there is also a demand for a method different from the methods disclosed in JP H04-235574 A and JP H07-134519 A, in which when a sheet remains in the apparatus due to occurrence of a jam or the like, the residual sheet is discharged without the toner image adhering to the fixing unit.

SUMMARY OF THE INVENTION

According to a first aspect of the present invention, an image forming apparatus, includes a conveyance unit that conveys a sheet, a conveyance path on which the sheet is conveyed by the conveyance unit, an image forming unit that forms an unfixed toner image on the sheet conveyed by the conveyance unit, a fixing unit that heats and pressurizes the sheet at a nip portion to fix the toner image formed by the image forming unit to the sheet, a temperature detection unit that detects a temperature of the fixing unit, and a control unit configured to execute a sheet discharge mode of conveying and discharging the sheet to an outside of the apparatus in a case where the sheet stops on the conveyance path. If a case where a sheet is stopped in a state where a leading edge of the sheet is positioned between the image forming unit and the nip portion and a distance between the leading edge of the sheet and the nip portion is a first distance is a first case, and a case where a sheet is stopped in a state where the leading edge of the sheet is positioned between the image forming unit and the nip portion, a distance between the leading edge of the sheet and the nip portion is a second distance shorter than the first distance and the temperature detected by the temperature detection unit is the same as that in the first case is a second case, the control unit is configured to set a conveyance speed of the sheet in discharging the sheet toward the nip portion in the second case to be slower than that in the first case, in the sheet discharge mode.

According to a second aspect of the present invention, an image forming apparatus, includes a conveyance unit that conveys a sheet, a conveyance path on which the sheet is conveyed by the conveyance unit, an image forming unit that forms an unfixed toner image on the sheet conveyed by the conveyance unit, a fixing unit that heats and pressurizes the sheet at a nip portion to fix the toner image formed by the image forming unit to the sheet, a temperature detection unit that detects a temperature of the fixing unit, and a control unit configured to execute a sheet discharge mode of conveying and discharging the sheet to an outside of the apparatus in a case where the sheet stops on the conveyance path. If a case where a sheet is stopped in a state where a leading edge of the sheet is positioned between the image forming unit and the nip portion and a distance between the leading edge of a toner image formed on the sheet and the nip portion is a third distance is a fifth case, and a case where a sheet is stopped in a state where the leading edge of the sheet is positioned between the image forming unit and the nip portion, a distance between the leading edge of a toner image formed on the sheet and the nip portion is a fourth distance shorter than the third distance and the temperature detected by the temperature detection unit is the same as that in the fifth case is a sixth case, the control unit is configured to set a conveyance speed in discharging the sheet toward the nip portion in the sixth case to be slower than that in the fifth case, in the sheet discharge mode.

According to a third aspect of the present invention, an image forming apparatus, includes a conveyance unit that conveys a sheet, a conveyance path on which the sheet is conveyed by the conveyance unit, an image forming unit that forms an unfixed toner image on the sheet conveyed by the conveyance unit, a fixing unit that heats and pressurizes the sheet at a nip portion to fix the toner image formed by the image forming unit to the sheet, a temperature detection unit that detects a temperature of the fixing unit, and a control unit configured to execute a sheet discharge mode of conveying and discharging the sheet to an outside of the apparatus in a case where the sheet stops on the conveyance path. If a case where a sheet is stopped in a state where a leading edge of the sheet is positioned between the image forming unit and the nip portion and a distance between the nip portion and a region where an image coverage of a toner image formed on the sheet exceeds a predetermined value is a fifth distance is a nineth case, and a case where a sheet is stopped in a state where a leading edge of the sheet is positioned between the image forming unit and the nip portion and a distance between the nip portion and a region where an image coverage of a toner image formed on the sheet exceeds the predetermined value is a sixth distance shorter than a fifth distance is a tenth case, the control unit is configured to set a conveyance speed of the sheet in discharging the sheet toward the nip portion in the tenth case to be slower than that in the nineth case, in the sheet discharge mode.

Further features of the present invention will become apparent from the following description of exemplary embodiments with reference to the attached drawings.

BRIEF DESCRIPTION OF THE DRAWINGS

FIG. 8 is a flowchart illustrating a sheet discharge mode according to the second embodiment.

DESCRIPTION OF THE EMBODIMENTS

Hereinafter, an image forming apparatus according to each embodiment will be described with reference to the drawings. The dimensions, materials, shapes, relative arrangements, and the like of the components described in the following embodiments are not intended to limit the scope of application of the present technology only to them unless otherwise specified.

First Embodiment

Schematic Configuration of Image Forming Apparatus

Figure 1:
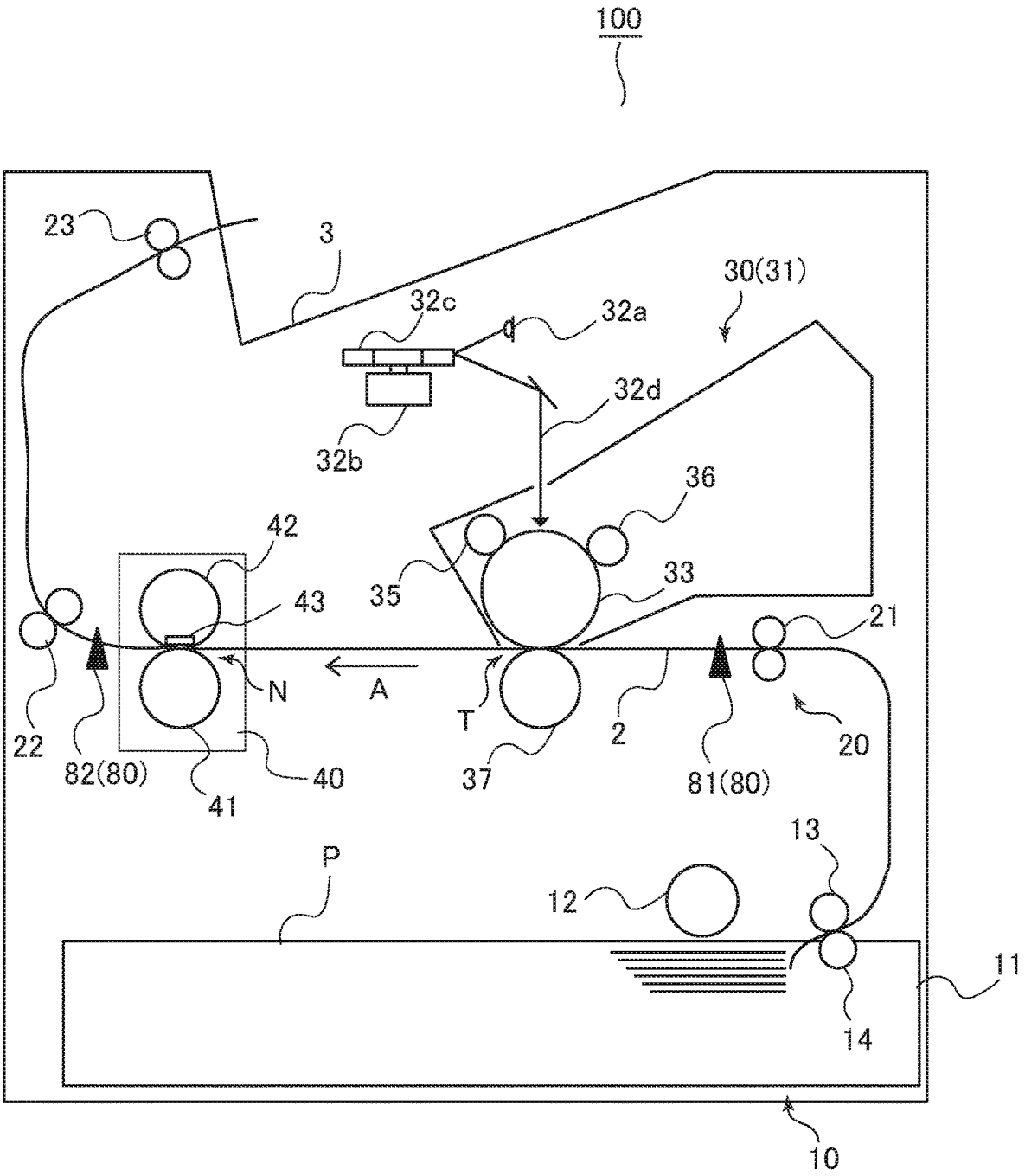
FIG. 1 is a schematic view of an image forming apparatus according to a first embodiment.

FIG. 1 is a schematic view illustrating an image forming apparatus 100 according to a first embodiment. In the present embodiment, the image forming apparatus 100 which is a laser beam printer of an electrophotographic system that forms an image on a sheet (recording material) will be described as an example. As the sheet, various sheets having different sizes and materials, such as paper such as plain paper and thick paper, a sheet material subjected to surface treatment such as a plastic film, cloth, and coated paper, and a sheet material having a special shape such as an envelope and index paper, can be used.

Figure 2:
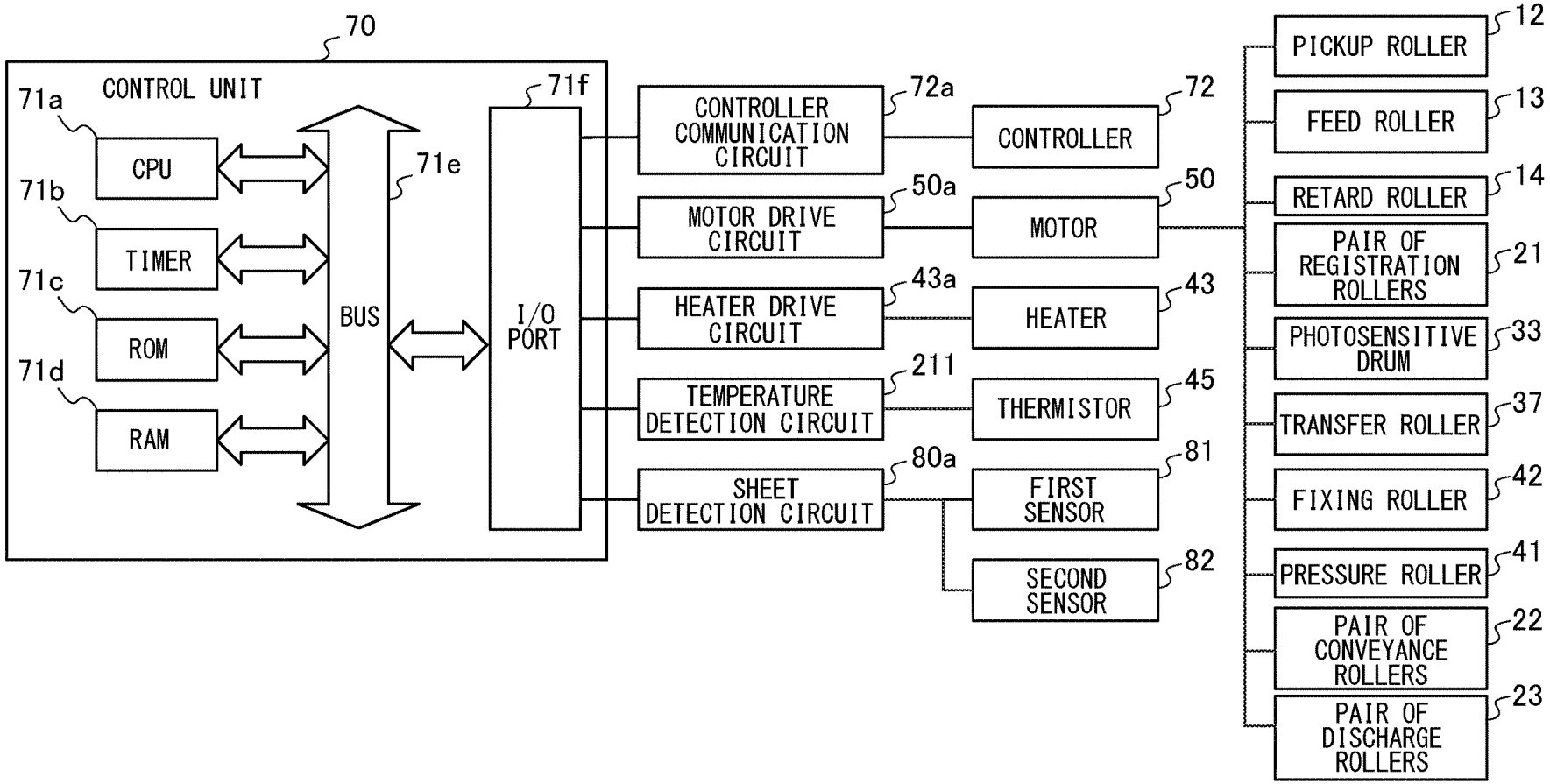
FIG. 2 is a block diagram illustrating a hardware configuration of the image forming apparatus.

The image forming apparatus 100 includes a sheet feeding unit 10 that feeds a sheet, a sheet conveying device 20 that conveys a sheet, an image forming unit 30 that forms a toner image on a sheet, a fixing device 40 that fixes the toner image to the sheet, a motor 50, and a control unit 70 (see FIG. 2). The image forming apparatus 100 further includes a sheet detection device 80 that detects a conveyed sheet.

The sheet feeding unit 10 is detachably provided with respect to the apparatus body, and includes a feeding cassette 11 as a sheet stacking portion that stacks and stores the sheet P. Further, the sheet feeding unit 10 includes a pickup roller 12 as a feeding unit that feeds the sheet stacked on the feeding cassette 11, and a feed roller 13 that receives and conveys the sheet P from the pickup roller 12. Further, the sheet feeding unit 10 includes a retard roller 14 that is pressed against the feed roller 13 and separates another sheet from the sheet P conveyed by the feed roller 13 by receiving a driving force in a direction opposite to a conveyance direction of the sheet by the feed roller 13. The sheet feeding unit 10 separates and feeds the sheets P stacked in the feeding cassette 11 one by one by the pickup roller 12, the feed roller 13, and the retard roller 14.

The sheet conveying device 20 as a conveyance unit includes a pair of registration rollers 21, a pair of conveyance rollers 22, and a pair of discharge rollers 23. Each of the pair of registration rollers 21, the pair of conveyance rollers 22, and the pair of discharge rollers 23 is constituted by two rollers that are arranged to face each other and rotate, and nips and conveys the sheet along a sheet conveyance path 2 by a nip portion formed between the two rollers. The pair of registration rollers 21 is in contact with the leading edge of the sheet P fed by the sheet feeding unit 10, that is, the downstream edge in the conveyance direction of the sheet to correct skew feeding of the sheet P, and conveys the sheet P toward the transfer nip T of the image forming unit 30.

The image forming unit 30 includes a photosensitive drum 33, a charging roller 35, a laser scanner 32, a developing roller 36, a transfer roller 37, and a cleaning device (not illustrated). In the present embodiment, the photosensitive drum 33, the charging roller 35, the developing roller 36, and the cleaning device are detachably provided as the process cartridge 31 with respect to the apparatus body of the image forming apparatus 100.

The photosensitive drum 33 as an image carrier rotates in a clockwise direction in FIG. 1. The charging roller 35 as a charging device uniformly charges (primarily charges) the peripheral surface of the photosensitive drum 33 to a predetermined polarity and potential by applying a charging voltage. The laser scanner 32 as an exposing unit includes a semiconductor laser 32*a* as a light source, a scanner motor 32*b*, and a rotary polygon mirror 32*c* that is rotated by the scanner motor 32*b* and reflects laser light of the semiconductor laser 32*a*. The laser scanner 32 outputs a laser light 32*d* that is on/off modulated according to image information input from an external device such as an image scanner (not illustrated) or a host computer 300 (see FIG. 3). The laser scanner 32 scans the peripheral surface of the photosensitive drum 33 while exposing the peripheral surface with the laser light 32*d* to remove electric charge in an exposed bright portion on the peripheral surface of the photosensitive drum 33, thereby forming an electrostatic latent image corresponding to image information input to the peripheral surface of the photosensitive drum 33.

The developing roller 36 as a developing unit is disposed to face the photosensitive drum 33, and rotates while carrying toner (developer) on the surface to supply the toner to the peripheral surface of the photosensitive drum 33, and sequentially develops the electrostatic latent image formed on the peripheral surface of the photosensitive drum 33 as a toner image. In the image forming apparatus 100 of the present embodiment, a reversal development system in which toner is adhered to an exposed bright portion of an electrostatic latent image and development is performed is used.

The transfer roller 37 as a transfer device is arranged to face the photosensitive drum 33, and forms a transfer nip T with the photosensitive drum 33 on the downstream of the pair of registration rollers 21 in the sheet conveyance direction (direction A illustrated in FIG. 1) on the sheet conveyance path 2. When a transfer voltage having a polarity opposite to that of the toner is applied, the transfer roller 37 electrostatically transfers the toner image formed on the peripheral surface of the photosensitive drum 33 to the surface of the sheet P nipped and conveyed at the transfer nip T. In other words, the transfer roller 37 transfers the toner image on the image carrier to the sheet at the transfer nip T on the sheet conveyance path to form an unfixed toner image on the sheet. After the toner image is transferred to the sheet P, the cleaning device removes residual toner, paper dust, and the like on the peripheral surface of the photosensitive drum 33.

In the present embodiment, the image forming apparatus 100 adopts a method of directly transferring the toner image from the photosensitive drum to the sheet, but is not limited thereto, and may adopt a method of transferring the toner image formed on the photosensitive member to the sheet via an intermediate transfer body such as an intermediate transfer belt.

The fixing device 40 as a fixing unit includes a cylindrical fixing film 42 and a pressure roller 41 that is disposed to face the fixing film 42 across the sheet conveyance path 2 and forms a fixing nip N as a nip portion with the fixing film 42. The fixing film 42 is formed using a metal such as stainless steel or a resin such as polyimide as a material of the base layer. The fixing device 40 includes a heater 43 as a heating body and a thermistor 45 (see FIG. 2) as a temperature detection unit that detects the temperature of the heater 43. The fixing film 42 is pressed against the pressure roller 41 by pressing the heater 43 toward the pressure roller 41. The fixing film 42 rotates together with the pressure roller 41 by a frictional force with the pressure roller 41 at the fixing nip N. The fixing nip N is disposed downstream of the transfer nip T in the sheet conveyance direction on the sheet conveyance path 2, and the fixing device 40 heats and pressurizes the sheet nipped by the fixing nip N to fix the toner image formed at the transfer nip T to the sheet.

The pair of conveyance rollers 22 is disposed downstream of the fixing nip N on the sheet conveyance path 2, and nips and conveys the sheet having passed through the fixing nip N toward the pair of discharge rollers 23. The pair of discharge rollers 23 is disposed downstream of the pair of conveyance rollers 22 on the sheet conveyance path 2. The pair of discharge rollers 23 nips and conveys the sheet, and discharges the sheet to the discharge tray 3.

The position of the sheet P on the sheet conveyance path 2 is detected by the sheet detection device 80. The sheet detection device 80 includes a first sensor 81 disposed between the pair of registration rollers 21 and the transfer nip T and a second sensor 82 disposed between the fixing nip N and the pair of conveyance rollers 22. The first sensor 81 and the second sensor 82 include, for example, a transmission type optical sensor or the like, and output a detection signal when the optical axis is shielded by the sheet conveyed along the sheet conveyance path 2.

The skew feeding of the sheet P fed by the sheet feeding unit 10 is corrected by the pair of registration rollers 21, and the sheet P is conveyed at a predetermined timing in accordance with the degree of progress of the image forming operation of the image forming unit 30. The leading edge of the sheet P conveyed by the pair of registration rollers 21 is detected by the first sensor 81 while being conveyed along the sheet conveyance path 2, and is conveyed toward the transfer nip T. The sheet P is further conveyed while an unfixed toner image is transferred at the transfer nip T, and is heated and pressed at the fixing nip N, which is a fixing position at which the toner image is fixed, so that the toner image is fixed thereon.

The sheet P on which the toner image has been fixed is conveyed along the sheet conveyance path 2, the leading edge of the sheet is detected by the second sensor 82, then further conveyed by the pair of conveyance rollers 22, and discharged to the discharge tray 3 by the pair of discharge rollers 23. By repeating the above operation, the image forming apparatus 100 sequentially forms images on the sheets of the sheet feeding unit 10.

The motor 50 (see FIG. 2) as a driving unit is configured as a single motor that drives each roller of the sheet feeding unit 10, each roller pair of the sheet conveying device 20, the photosensitive drum 33, the charging roller 35, the developing roller 36, the transfer roller 37, and the pressure roller 41. Therefore, each unit driven by the motor 50 is controlled so as to have the same conveyance speed. As a result, the image forming apparatus 100 according to the present embodiment can reduce the size and cost of the apparatus, eliminates the need to individually perform acceleration/deceleration control on a plurality of motors, and can reduce the processing load on the control unit 70. Note that the image forming apparatus 100 may be configured to be able to connect and disconnect power from the motor 50 to each unit by a clutch mechanism (not illustrated).

Hardware Configuration

FIG. 2 is a block diagram illustrating a hardware configuration of the image forming apparatus 100. Note that FIG. 2 mainly illustrates a hardware configuration related to the control of the present embodiment, and omits other configurations. The control unit 70 includes an input/output (I/O) port 71*f*, and inputs and outputs signals to and from each unit of the image forming apparatus 100 via the I/O port 71*f*. In addition, the control unit 70 includes a central processing unit (CPU) 71*a* that interprets a program instruction, a timer 71*b* that manages time, a read-only memory (ROM) 71*c* that stores data and a program, and a random access memory (RAM) 71*d* that temporarily holds data. The timer 71*b*, the ROM 71*c*, the RAM 71*d*, and the I/O port 71*f* are connected to the CPU 71*a* via a bus 71*e*.

The image forming apparatus 100 includes a controller 72 for connecting the host computer 300 and the control unit 70. The controller 72 is connected to the I/O port 71*f* via the controller communication circuit 72*a*. In addition, the control unit 70 operates the motor 50 by the motor drive circuit 50*a* to drive each roller of the sheet feeding unit 10, each roller pair of the sheet conveying device 20, the photosensitive drum 33, the transfer roller 37, and the pressure roller 41 via a gear (not illustrated).

The control unit 70 controls energization to the heater 43 of the fixing device 40 by the heater drive circuit 43*a* to perform temperature adjustment control of the fixing device 40. A temperature of fixing device 40 is detected by thermistor 45, and a detection signal from thermistor 45 is input to control unit 70 through a temperature detection circuit 211. The first sensor 81 and the second sensor 82 on the sheet conveyance path 2 input detection signals to the control unit 70 via the sheet detection circuit 80*a*.

Control Configuration

Figure 3:
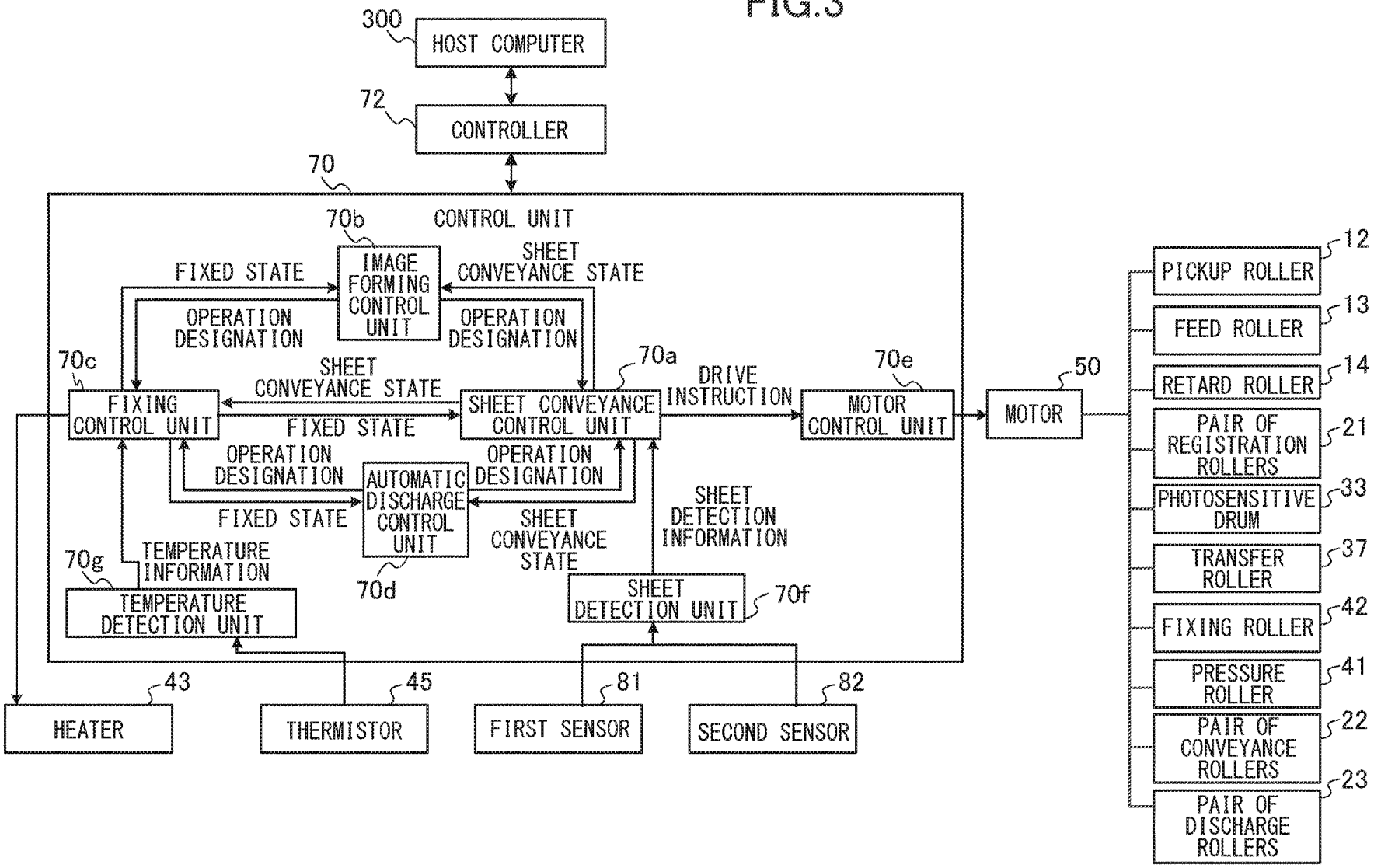
FIG. 3 is a block diagram illustrating a control configuration of the image forming apparatus.

FIG. 3 is a block diagram illustrating a control configuration of the image forming apparatus 100 according to the present embodiment. In FIG. 3, a control configuration mainly related to the control of the present embodiment is illustrated, and other configurations are omitted. The control unit 70 includes a sheet conveyance control unit 70*a*, an image forming control unit 70*b*, a fixing control unit 70*c*, an automatic discharge control unit 70*d*, a motor control unit 70*e*, a sheet detection unit 70*f*, and a temperature detection unit 70*g*. The controller 72 receives an image forming instruction from the host computer 300, and outputs an image forming signal to the control unit 70 based on the received information.

Based on an image forming signal from the controller 72, the control unit 70 controls the fixing control unit 70*c* and the sheet conveyance control unit 70*a* by the image forming control unit 70*b* to perform an image forming operation. In addition, the control unit 70 controls the operation of the motor 50 by the sheet conveyance control unit 70*a* via the motor control unit 70*e* based on an input signal from the sheet detection device 80 and an input signal from the thermistor 45. In addition, the control unit 70 controls the temperature of the heater 43 in the device by the fixing control unit 70*c* based on an input signal from the sheet detection device 80 and an input signal from the thermistor 45.

In addition, the control unit 70 can execute a sheet discharge mode in which the fixing control unit 70*c* and the sheet conveyance control unit 70*a* are controlled by the automatic discharge control unit 70*d* on the basis of an input signal from the sheet detection device 80 and an input signal from the thermistor 45 to discharge a residual sheet in the apparatus. Details of the sheet discharge mode will be described later.

Outline of Sheet Discharge Mode

Next, an outline of the sheet discharge mode executed by the control unit 70 will be described. As described above, the image forming apparatus 100 according to the present embodiment executes image forming process of forming an image on a sheet in response to an image forming signal from the controller 72. During execution of the image forming process, the image forming process may be interrupted due to a jam, opening of a door (not illustrated) by a user, or the like, and the sheet may stop on the sheet conveyance path 2. In a case where the sheet stops on the sheet conveyance path 2 in this manner, for example, when the door is closed again by releasing the jam or the like, the control unit 70 executes a sheet discharge mode in which the sheet (hereinafter, referred as the residual sheet) stopped on the sheet conveyance path 2 is automatically discharged and conveyed to the outside of the apparatus.

When the image forming process is interrupted, the driving of the fixing device 40 and the power supply to the heater 43 are stopped, and the temperature of the fixing device 40 decreases with the lapse of time. For this reason, when the sheet discharge mode for discharging and conveying the residual sheet is executed, the temperature of the fixing device 40 may be lowered to a temperature lower than the sheet dischargeable temperature depending on the elapsed time from the interruption of the image forming process. In addition, when the residual sheet on which the unfixed toner image is formed is caused to pass through the fixing nip N in a state where the temperature of the fixing device 40 is lowered to a temperature lower than the sheet dischargeable temperature, a fixing failure may occur in which the toner image is not sufficiently fixed to the sheet. When the fixing failure occurs, unfixed toner adheres to the fixing film 42, and the fixing film 42 may be contaminated with the toner. In the present embodiment, the sheet dischargeable temperature is a temperature of the heater 43 that can suppress a fixing failure when the sheet passes through the fixing nip N at a normal conveyance speed (for example, 262.5 mm/sec) at which the sheet is conveyed in a normal image forming operation.

Therefore, in the image forming apparatus 100 of the present embodiment, the fixing device 40 and the sheet conveying device 20 are controlled so that the residual sheet passes through the fixing nip N after the temperature of the fixing device 40 rises to the sheet dischargeable temperature in the sheet discharge mode executed by the control unit 70. Hereinafter, the sheet discharge mode in the present embodiment will be described with reference to the flowchart of FIG. 4.

Figure 4:
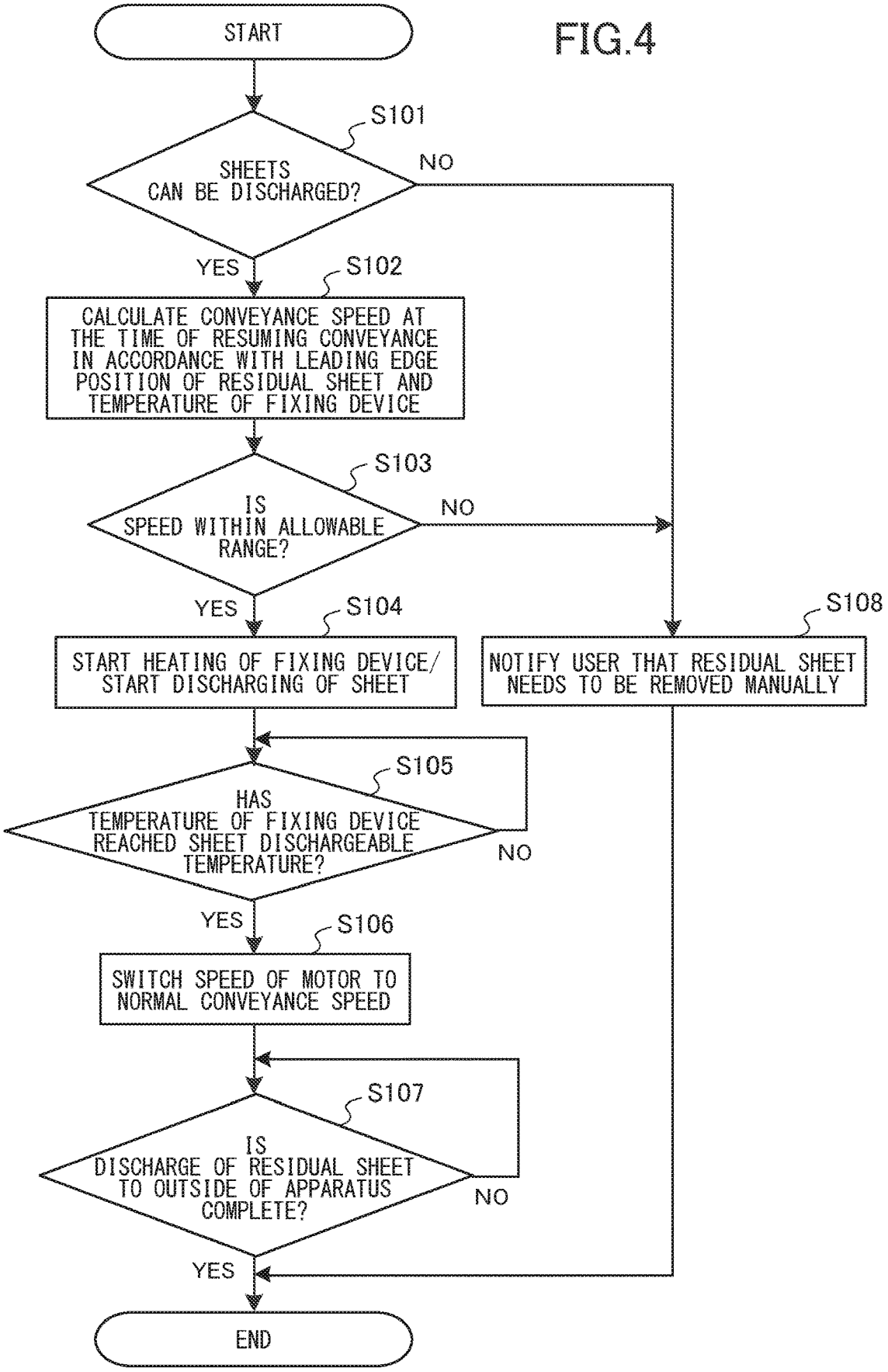
FIG. 4 is a flowchart illustrating a sheet discharge mode.

As illustrated in FIG. 4, when the sheet discharge mode is started, the control unit 70 first determines whether the residual sheets can be discharged and conveyed by the sheet conveying device 20 (S101). In a case where the residual sheet is jammed on the sheet conveyance path 2 or in a case where the residual sheet is stopped in a state of being nipped by the fixing nip N, it is determined that conveyance is not possible. In the process of step S101, when the residual sheet cannot be conveyed (NO of S101), the control unit 70 notifies that manual removal (discharge) by the user is necessary using a buzzer, a liquid crystal display, or the like (not illustrated) (S108), and ends the sheet discharge mode.

In the process of step S101, when the sheet can be conveyed (YES in S101), the control unit 70 calculates a conveyance speed at the time of discharging and conveying the residual sheet (S102). In this process, the control unit 70 calculates the conveyance speed so that the temperature of the fixing device 40 reaches the sheet dischargeable temperature when the leading edge of the residual sheet that has stopped in a state where the leading edge (downstream edge) of the sheet is located on the upstream of the fixing nip N reaches the fixing nip N. Details of the process of calculating the conveyance speed will be described later.

When the process of step S102 is executed, the control unit 70 determines whether the calculated conveyance speed is within an allowable range (S103). In this process, the control unit 70 determines whether the rotational speed of the motor 50 corresponding to the calculated conveyance speed is equal to or higher than the minimum rotational speed and equal to or lower than the maximum rotational speed of the motor 50.

In the process of step S103, when the calculated conveyance speed is out of the allowable range (NO of S103), it is determined that the residual sheets cannot be conveyed, and the process of step 5108 is executed to end the sheet discharge mode.

When the calculated conveyance speed is within the allowable range (YES in S103), the heating of the heater 43 is started, and the operation of the motor 50 is started to drive the pressure roller 41, the sheet conveying device 20, and the image forming unit 30 to resume the conveyance of the residual sheet (S104). After only heating of the heater 43 is performed without operating the motor 50, the motor 50 may be operated to resume the conveyance of the residual sheet. In this case, in order to shorten the time until the residual sheet is discharged, the conveyance of the residual sheet may be resumed at a time point when the temperature of the fixing device 40 reaches a predetermined temperature lower than the sheet dischargeable temperature.

After the conveyance of the residual sheet is resumed, when the temperature of the fixing device 40 has not reached the sheet dischargeable temperature (NO in S105), the control unit 70 continues the conveyance of the residual sheet while maintaining the rotational speed of the motor 50, that is, the conveyance speed of the sheet. When the temperature of the fixing device 40 reaches the sheet dischargeable temperature after the conveyance of the residual sheet is resumed (YES in S105), the control unit 70 switches the rotational speed of the motor as necessary (S106). In this process, for example, when the conveyance speed of the residual sheet before the temperature of the fixing device 40 reaches the sheet dischargeable temperature is lower than the normal conveyance speed at the time of executing the image forming process, the control unit 70 switches the rotational speed of the motor so that the conveyance speed becomes the normal conveyance speed.

When the process of step S106 is executed, it is determined whether all the residual sheets in the image forming apparatus 100 have been discharged to the outside of the apparatus (S107). In the process of step S107, when all the residual sheets have not been discharged to the outside of the apparatus (NO in S107), the conveyance of the residual sheets is continued, and when all the residual sheets have been discharged to the outside of the apparatus (YES in S107), the sheet discharge mode is ended.

Conveyance Speed in Sheet Discharge Mode

As described above, when the sheet passes through the fixing nip N in a state where the temperature of the fixing device 40 has not reached the sheet dischargeable temperature after the toner image is transferred to the sheet at the transfer nip T, there is a possibility that unfixed toner adheres to the fixing film 42. That is, in the sheet discharge mode, if the temperature of the fixing device 40 does not reach the sheet dischargeable temperature when the leading edge of the residual sheet reaches the fixing nip N, there is a possibility that the toner adheres to the fixing film 42.

Therefore, in the present embodiment, in the sheet discharge mode, the sheet is conveyed at a speed at which the temperature of the fixing device 40 reaches the sheet dischargeable temperature when the leading edge of the sheet closest to the fixing device 40 among the residual sheets stopped on the upstream side in the conveyance direction of the fixing device 40 reaches the fixing nip N. In the present embodiment, the control unit 70 obtains (calculates) the conveyance speed at the start of conveyance of the residual sheet in the sheet discharge mode based on the temperature of the heater 43 and the position of the residual sheet on the sheet conveyance path 2 by the automatic discharge control unit 70*d*. Specifically, when the temperature of the fixing device 40 is the same, the control unit 70 makes the conveyance speed in discharging the residual sheet toward the fixing nip N slower in a case where a distance between the fixing nip N and the leading edge of the residual sheet is a second distance shorter than a first distance than in a case where the distance between fixing nip N and the leading edge of the residual sheet is the first distance. In the present embodiment, the temperature of the fixing device 40 is the temperature of the heater 43 of the fixing device 40. In addition, when the distance between the fixing nip N and the leading edge of the residual sheet is the same, the control unit 70 makes the conveyance speed to be slower in a case where a temperature of the fixing device 40 at the start of the sheet discharge mode is a second temperature lower than a first temperature than in a case where the temperature of the fixing device 40 at the start of the sheet discharge mode is the first temperature. Hereinafter, processing of calculating the conveyance speed of the sheet in the sheet discharge mode will be described.

In the present embodiment, the ROM 71*c* of the control unit 70 stores the time required for the rise from the predetermined temperature to the sheet dischargeable temperature (hereinafter, referred to heating time) in a case where the maximum power that can be output to the heater 43 is applied. For example, the ROM 71*c* stores that the sheet dischargeable temperature is 180° C., and the time required for the temperature to rise from 20° C. to 180° C. is 4 seconds. In other words, the heating time from 20° C. to 180° C. is stored as 4 seconds. For example, assuming that the heating time and the rising temperature are in a proportional relationship, the heating time from 100° C. to 180° C. can be calculated as 2 seconds.

In the present embodiment, ROM 71*c* stores the heating time from 20° C. to 180° C., but the present disclosure is not limited thereto. The ROM 71*c* may store the heating time from a plurality of temperatures to the sheet dischargeable temperature, and for example, the ROM 71*c* may store the heating time from each temperature of 20° C., 50° C., 80° C., and 100° C. to 180° C. As described above, when the heating time from a plurality of temperatures to the sheet dischargeable temperature is stored, it is possible to calculate the heating time more accurately from an arbitrary temperature to the sheet dischargeable temperature.

Further, for example, the ROM 71*c* may store not the heating time from each temperature to the sheet dischargeable temperature, but the time required for the temperature rise in each section such as from 20° C. to 50° C., from 50° C. to 80° C., and from 80° C. to 100° C. Furthermore, for example, the control unit 70 may calculate the heating time from a predetermined temperature to the sheet dischargeable temperature by performing heat quantity calculation in consideration of the power supplied to the heater 43, the heat capacity or radiation of the fixing device 40, and the like.

The control unit 70 calculates the position of the leading edge (downstream edge) of the sheet on the sheet conveyance path 2 during the execution of the image forming process by the sheet conveyance control unit 70*a*. Specifically, the control unit 70 calculates the position of the leading edge of the sheet based on the conveyance distance (movement length along the sheet conveyance path 2) of the sheet after the leading edge of the sheet is detected by the first sensor 81. For example, the control unit 70 calculates the conveyance distance of the sheet based on the elapsed time from the detection of the leading edge of the sheet by the first sensor 81, the conveyance speed of the sheet, and the rotational speed of the motor 50.

As a result, even when the image forming process is interrupted due to a jam, opening of a door by a user, or the like, it is possible to acquire the position of the leading edge of the residual sheet stopped on the sheet conveyance path 2. The control unit 70 calculates a conveyance speed at which the temperature of the fixing device 40 reaches the sheet dischargeable temperature when the leading edge of the sheet reaches the fixing nip N based on the length (distance) along the sheet conveyance path 2 from the leading edge position of the residual sheet to the fixing nip N of the fixing device 40 and the previously obtained heating time. Specifically, the conveyance speed v at the time of conveying the sheet to the fixing nip N in the sheet discharge mode can be calculated by dividing the distance 1 from the leading edge of the sheet to the fixing nip N by the heating time t ($v=l/t$).

Figure 5:
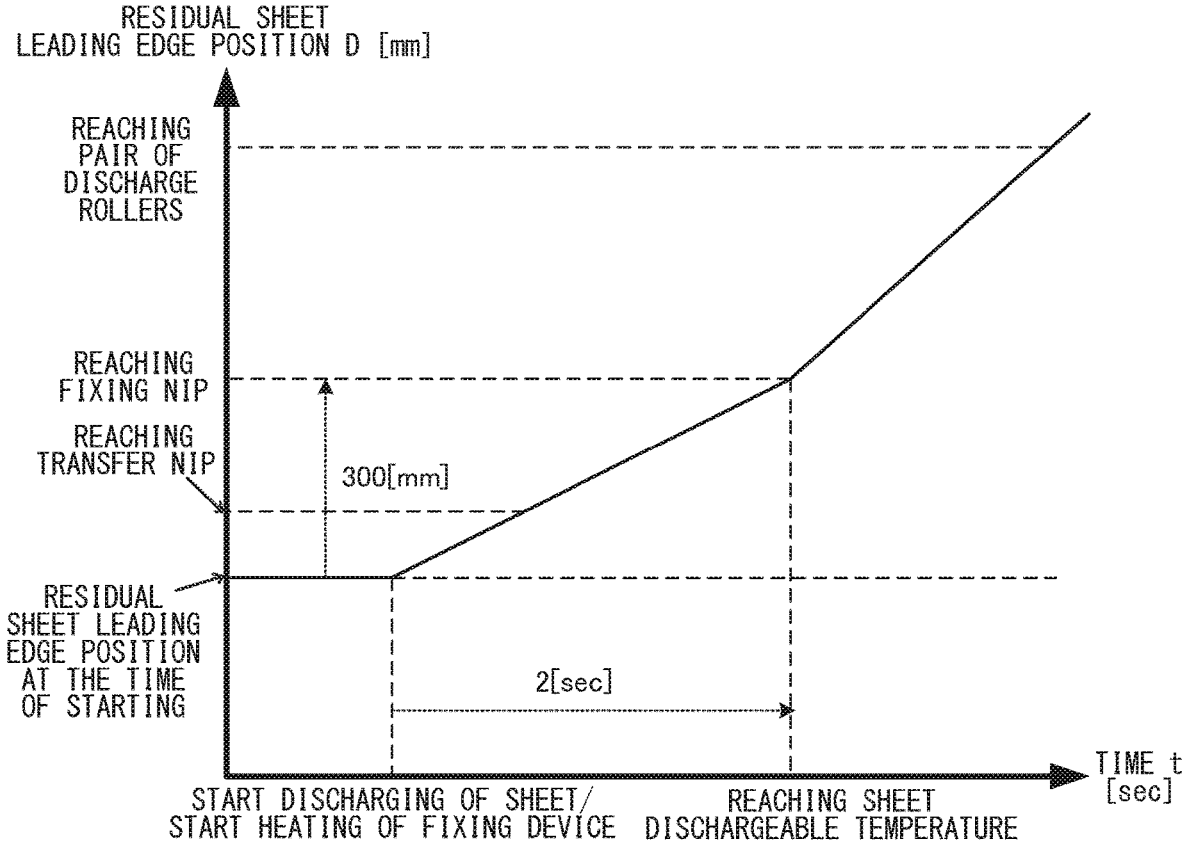
FIG. 5 is a diagram illustrating a temporal change of a position of a leading edge of a residual sheet when the sheet discharge mode is executed.

FIG. 5 is a diagram illustrating a temporal change in the position of the leading edge of the residual sheet when the sheet discharge mode of the present embodiment is executed. For example, when the distance from the position of the leading edge of the residual sheet to the fixing nip N in the downstream direction is 300 mm, the conveyance speed at which the leading edge of the residual sheet reaches the fixing nip N in 2 seconds after the conveyance of the residual sheet is resumed is 150 mm/sec. In other words, in a case where the position of the leading edge of the residual sheet is located 300 mm upstream of the fixing nip N, when the residual sheet is conveyed toward the fixing nip N at a conveyance speed of 150 mm/sec, the leading edge of the residual sheet reaches the fixing nip N after 2 sec. In the sheet discharge mode, in a case where the temperature of the fixing device 40 at the start of the sheet discharge mode is a temperature lower than the sheet dischargeable temperature, the control unit 70 starts heating the fixing device 40 by applying maximum power to the heater 43 together with resuming conveyance of the residual sheet.

For example, consider a case where a temperature of the fixing device 40 at the time when the sheet discharge mode is started is 100° C., and a distance from the position of the leading edge of the residual sheet to the fixing nip N in the downstream direction is 300 mm. In this case, when the residual sheet is conveyed toward the fixing nip N at a conveyance speed of 150 mm/sec together with the start of heating of the fixing device 40, the temperature of the fixing device 40 reaches 180° C., which is the sheet dischargeable temperature in the present embodiment, when the leading edge of the residual sheet reaches the fixing nip N.

According to the present embodiment, by setting the conveyance speed as described above, it is possible to cause the residual sheet to pass through the fixing nip N in a state where the temperature has reached the sheet dischargeable temperature. As a result, it is possible to discharge the residual sheet in the apparatus while suppressing the fixing failure of the toner image at the time of discharging the sheet and preventing the fixing device 40 from being contaminated with the toner image. In addition, since it is not necessary to separately control the conveyance speed of the fixing device 40 and the sheet conveying device 20 when the residual sheet is discharged, it is possible to prevent contamination of the fixing device 40 with the toner image by conveying the residual sheet by simple control.

Further, according to the present embodiment, even when the fixing device 40 and the sheet conveying device 20 are driven by the single motor 50, it is possible to heat the fixing device 40 while conveying the residual sheet, and it is possible to reduce the size and cost of the device. In the sheet discharge mode, when the leading edge of the residual sheet closest to the fixing nip N on the downstream in the sheet conveyance direction reaches the fixing nip N, the control unit 70 increases the conveyance speed to a normal conveyance speed to discharge the sheet. As a result, the time for the sheet to be discharged can be shortened, and workability can be improved.

In general, an acceleration period of several 10 msec to several 100 msec is required until the motor is started and steadily rotated. During this acceleration period, the rotational speed is slower than the rotational speed during the steady rotation. Therefore, strictly speaking, when the residual sheet is conveyed toward the fixing nip N at the above-described conveyance speed, the temperature of the fixing device 40 reaches the sheet dischargeable temperature before the leading edge of the sheet reaches the fixing nip N. By setting the conveyance speed in this manner, even when there is an error in the leading edge position of the sheet, the conveyance speed of the residual sheet, the temperature and the temperature rising time of the fixing device 40, and the like, it is possible to suppress the leading edge of the sheet from reaching the fixing nip N before the temperature of the fixing device 40 reaches the sheet dischargeable temperature. The control unit 70 may calculate the conveyance speed of the residual sheet in consideration of the conveyance distance of the residual sheet in the acceleration period of the motor 50.

In addition, the image forming apparatus 100 is not limited to one that can rotate the motor 50 at any rotational speed from the minimum rotational speed to the maximum rotational speed. For example, the motor 50 may be rotatable only at a plurality of specific rotational speeds among the rotational speeds from the minimum rotational speed to the maximum rotational speed. In such a case, the control unit 70 may operate the motor 50 so that the rotational speed becomes the closest rotational speed on the side slower than the rotational speed of the motor 50 corresponding to the conveyance speed calculated as described above.

Further, the control unit 70 may be configured to include a nonvolatile memory and store the position of the leading edge of the residual sheet in the sheet discharge mode in the nonvolatile memory. As a result, for example, even when the power supply is stopped while the residual sheet is held on the sheet conveyance path 2, the position of the residual sheet can be grasped after the power supply is restored.

In the present embodiment, the case where the heating time from the start of the sheet discharge mode is longer than the time until the leading edge of the residual sheet conveyed at the normal conveyance speed reaches the fixing nip N has been described. However, there may be a case where the difference between the temperature at the start of the sheet discharge mode and the sheet dischargeable temperature is small, and the heating time is shorter than the time until the leading edge of the residual sheet reaches the fixing nip N.

In such a case, when the conveyance speed is calculated as described above, the conveyance speed at the start of the sheet discharge mode is calculated as a speed higher than the normal conveyance speed. In such a case, the control unit 70 may set the conveyance speed at the start of the sheet discharge mode to a conveyance speed higher than a normal conveyance speed within an allowable range of the conveyance speed, or to a normal conveyance speed. When the temperature at the start of the sheet discharge mode has reached the sheet dischargeable temperature, the control unit 70 may discharge and convey the sheet at an upper limit speed within the allowable range of the conveyance speed.

Further, when the sheet stops in a state where at least the leading edge of the sheet is positioned between the transfer nip T (image forming unit) and the fixing nip N, the control unit 70 may discharge and convey the sheet at a conveyance speed set based on the distance from the leading edge of the sheet to the fixing nip N and the heating time. For example, in a case where the sheet stops in a state where the leading edge of the sheet is located on the upstream of the transfer nip T, and a toner image is not formed on the sheet even if the sheet is conveyed, the sheet may be discharged and conveyed at a normal conveyance speed. Specifically, when the timing at which the sheet stops on the sheet conveyance path 2 is before the formation of the electrostatic latent image on the photosensitive drum 33, the control unit 70 may interrupt the formation of the electrostatic latent image on the photosensitive drum 33 and discharge and convey the residual sheet on the sheet conveyance path 2 at a normal conveyance speed. Further, even in a case where the sheet is stopped in a state where the leading edge of the sheet is located on the upstream of the transfer nip T, when a toner image is formed on the sheet by conveying the sheet, the control unit 70 may discharge and convey the sheet at a conveyance speed lower than a normal conveyance speed.

Further, in the present embodiment, the image forming apparatus 100 in which the sheet dischargeable temperature is 180° C. has been described as an example, but the sheet dischargeable temperature is not limited thereto. The sheet dischargeable temperature may be another temperature, or may be, for example, a temperature set (changed) according to the characteristics (grammage, surface property, and the like) of the sheet, the image coverage of the toner image, the maximum density of the toner image, and the like.

Second Embodiment

Hereinafter, a second embodiment will be described with reference to FIGS. 6 to 9. The second embodiment is different from the first embodiment in the processing of calculating the conveyance speed of the sheet in the sheet discharge mode. Other configurations are the same as those of the first embodiment, and the same configurations as those of the first embodiment are denoted by the same reference numerals in the drawings, and description thereof is omitted.

In the first embodiment, when the leading edge of the residual sheet reaches the fixing nip N, the conveyance speed of the residual sheet is set so that the temperature becomes the sheet dischargeable temperature. In the present embodiment, the conveyance speed of the residual sheet in the sheet discharge mode is set according to the leading edge position of the toner image on the residual sheet. Specifically, the conveyance speed is made slower in discharging the residual sheet toward the fixing nip N in a case where a distance between the fixing nip N and the leading edge of the toner image of the residual sheet is a fourth distance shorter than a third distance than in a case where the distance between fixing nip N and the leading edge of the residual sheet is the third distance.

Figure 6:
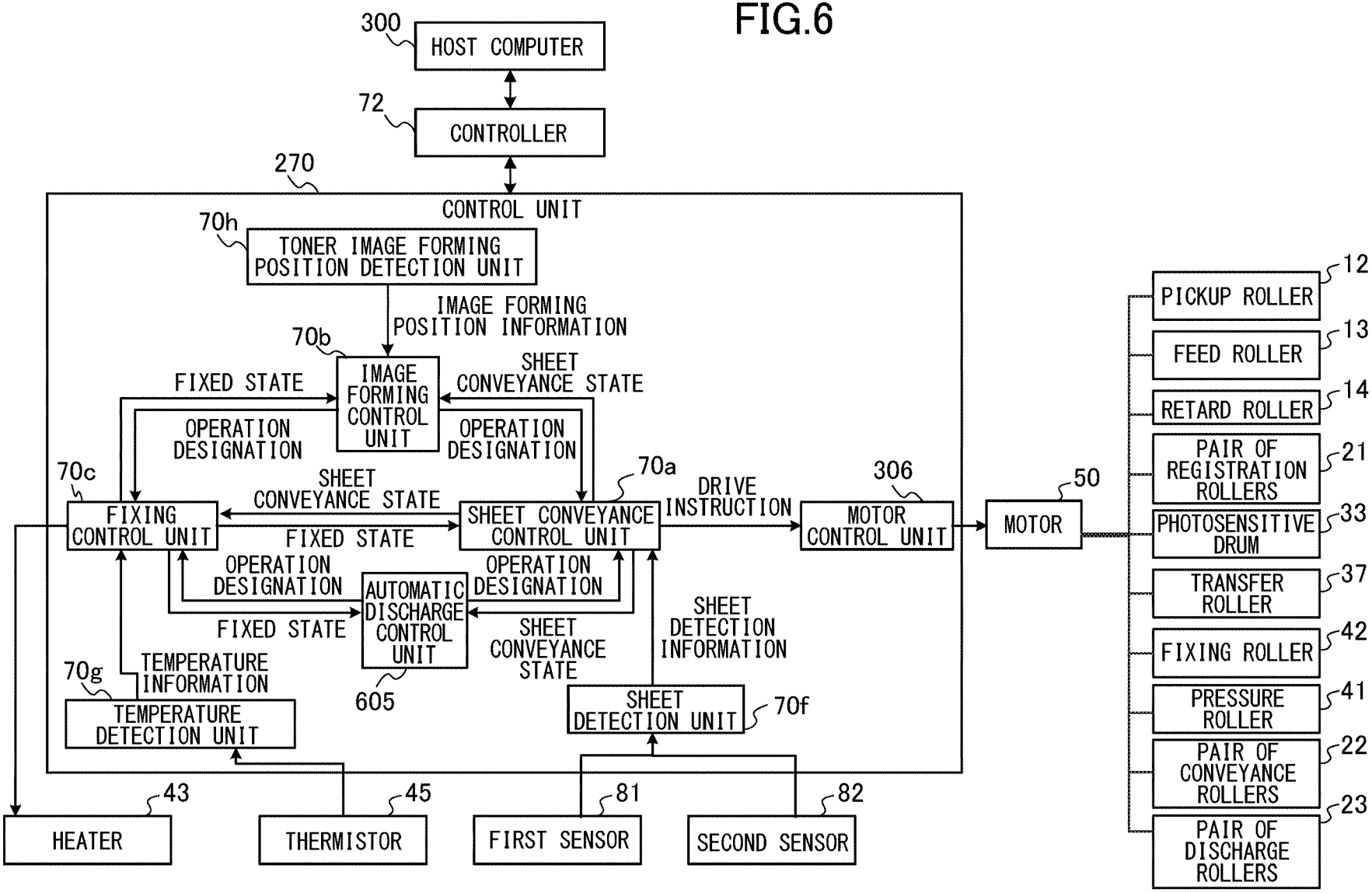
FIG. 6 is a diagram illustrating a hardware configuration of an image forming apparatus according to a second embodiment.

FIG. 6 is a block diagram illustrating a control configuration of the image forming apparatus 100 according to the present embodiment. In FIG. 6, a control configuration mainly related to the control of the present embodiment is illustrated, and other configurations are omitted. The control unit 270 includes a sheet conveyance control unit 70*a*, an image forming control unit 70*b*, a fixing control unit 70*c*, an automatic discharge control unit 70*d*, a motor control unit 70*e*, a sheet detection unit 70*f*, a temperature detection unit 70*g*, and a toner image forming position detection unit 70*h*.

The control unit 270 causes the toner image forming position detection unit 70*h* to acquire image forming position information indicating a position where a toner image is formed with respect to a sheet edge. In addition, the control unit 270 outputs information regarding the image forming state including the acquired image forming position information to the sheet conveyance control unit 70*a* by the image forming control unit 70*b*.

The control unit 270 calculates the position of the leading edge of the sheet from the conveyance distance of the sheet after the leading edge of the sheet is detected by the first sensor 81, and acquires the position of the leading edge of the toner image of the residual sheet based on the position of the leading edge of the sheet and the position of the toner image from the leading edge of the sheet. In other words, the control unit 70 obtains the position of the leading edge of the toner image formed on the sheet on the sheet conveyance path 2 based on the detection result of the sheet detection device 80 and the image information for the image forming unit 30 to form the toner image on the sheet.

The position where the toner image is formed with respect to the sheet edge may be acquired by analyzing an image forming signal transmitted from the controller 72 in the control unit 270, or may be acquired by directly inputting information related to the position where the toner image is formed from the controller 72. In addition, the actually formed toner image may be detected using an optical sensor or the like on a photosensitive drum or a sheet, or on an intermediate transfer body in an image forming apparatus having the intermediate transfer body.

Figure 7A:
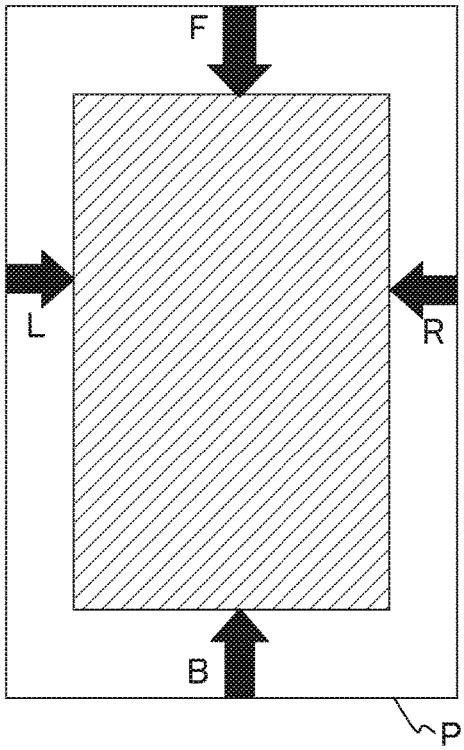
FIG. 7A is a schematic view illustrating a toner image formed on a sheet according to the second embodiment.

As illustrated in FIG. 7A, for example, the information regarding the image forming state acquired by the control unit 270 includes margin information from the sheet edge as the image forming position information. The margin information includes a distance F from a leading edge (downstream edge) of the sheet to a leading edge of the toner image, a distance B from a trailing edge (upstream edge) of the sheet to a trailing edge of the toner image, a distance L from a left edge of the sheet to the toner image, and a distance R from a right edge of the sheet to the toner image.

In the present embodiment, the control unit 270 determines that the leading edge of the toner image exists at the position of the distance F from the leading edge of the sheet in the sheet discharge mode. As a result, the control unit 270 sets the conveyance speed of the residual sheet such that the temperature of the fixing device 40 reaches the sheet dischargeable temperature when the position of the leading edge of the toner image reaches the fixing nip N. Hereinafter, the sheet discharge mode in the present embodiment will be described with reference to the flowchart of FIG. 8.

As shown in FIG. 8, in the process of step S101, when the sheet can be conveyed (YES in S101), the control unit 270 calculates a conveyance speed at the time of discharging and conveying the residual sheet (S202). In this process, the control unit 270 calculates the conveyance speed at which the temperature of the fixing device 40 reaches the sheet dischargeable temperature when the leading edge of the toner image of the residual sheet stopped in a state where the leading edge of the sheet is positioned between the transfer nip T and the fixing nip N reaches the fixing nip N.

Figure 9:
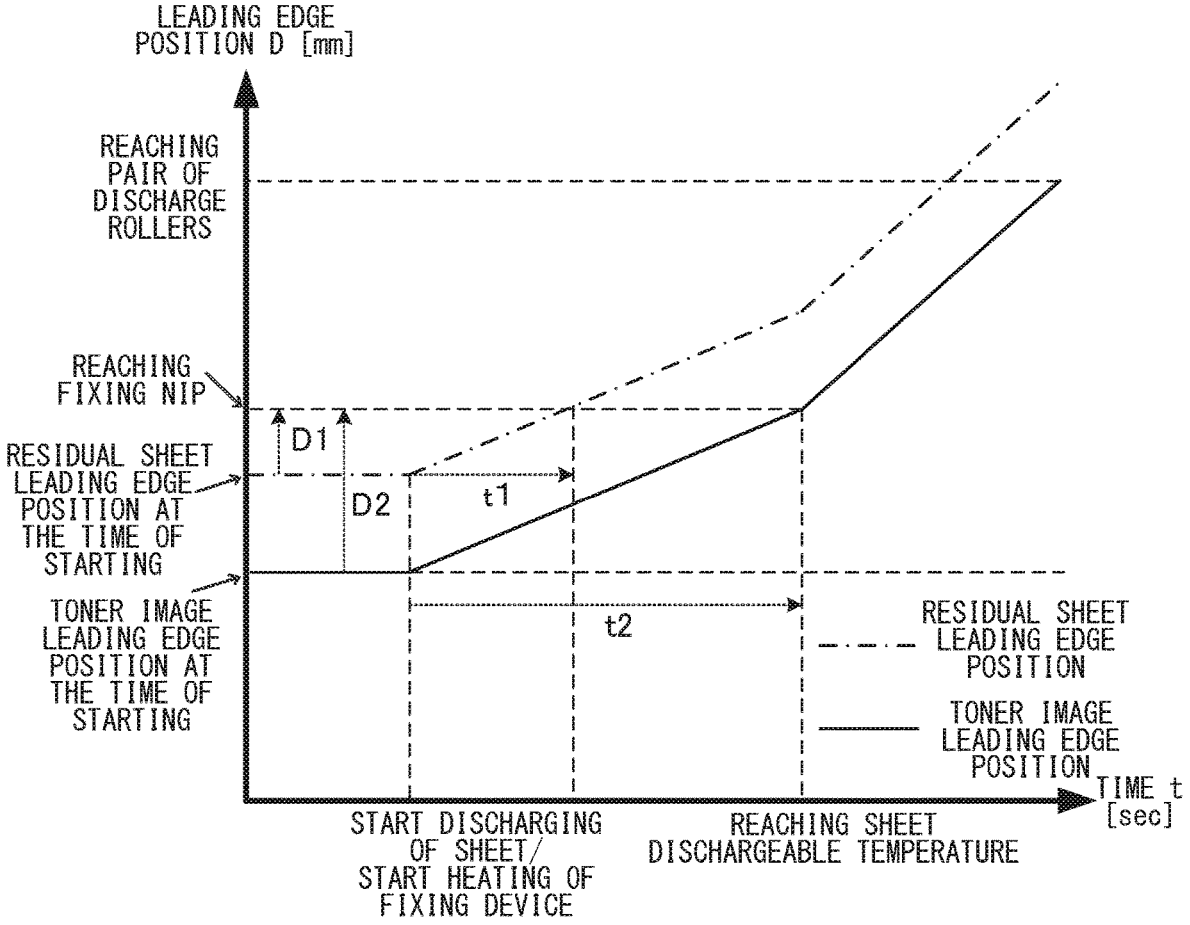
FIG. 9 is a diagram illustrating a temporal change of a position of a leading edge of a residual sheet when the sheet discharge mode according to the second embodiment is executed.

FIG. 9 is a diagram illustrating temporal changes of the position of the leading edge of the residual sheet and the position of the leading edge of the toner image of the residual sheet at the time of executing the sheet discharge mode of the present embodiment.

For example, at the start of the sheet discharge mode, the distance from the position of the leading edge of the residual sheet to the fixing nip N is defined as a distance D1, and the distance from the position of the leading edge of the toner image of the residual sheet to the fixing nip N is defined as a distance D2. In the first embodiment, the conveyance speed of the residual sheet is determined on the basis of the distance D1, but in the present embodiment, the conveyance speed of the residual sheet is set by the distance D2, that is, the distance from the position of the leading edge of the toner image of the residual sheet to the fixing nip N.

In a case where the conveyance speed is set in this manner, as illustrated in FIG. 9, the time t1 until the leading edge of the residual sheet reaches the fixing nip N is shorter than the heating time t2, and thus, the temperature of the fixing device 40 does not reach the sheet dischargeable temperature at the time when the residual sheet reaches the fixing nip N. However, since the toner does not exist in the region from the leading edge of the residual sheet to the leading edge of the toner image, even if this region is nipped by the fixing nip N, the fixing failure of the toner due to the low temperature of the fixing device 40 does not occur.

According to the present embodiment, when the leading edge of the toner image of the residual sheet reaches the fixing nip N, the conveyance speed of the residual sheet is set such that the temperature of the fixing device 40 reaches the sheet dischargeable temperature. As a result, it is possible to convey the residual sheet at a higher conveyance speed than in a case where the conveyance speed is set such that the temperature of the fixing device 40 reaches the sheet dischargeable temperature when the leading edge of the residual sheet reaches the fixing nip N.

Third Embodiment

Hereinafter, a third embodiment will be described with reference to FIG. 7B. The third embodiment is different from the first embodiment in the process of determining the conveyance speed of the sheet in the automatic discharge process.

Figure 7B:
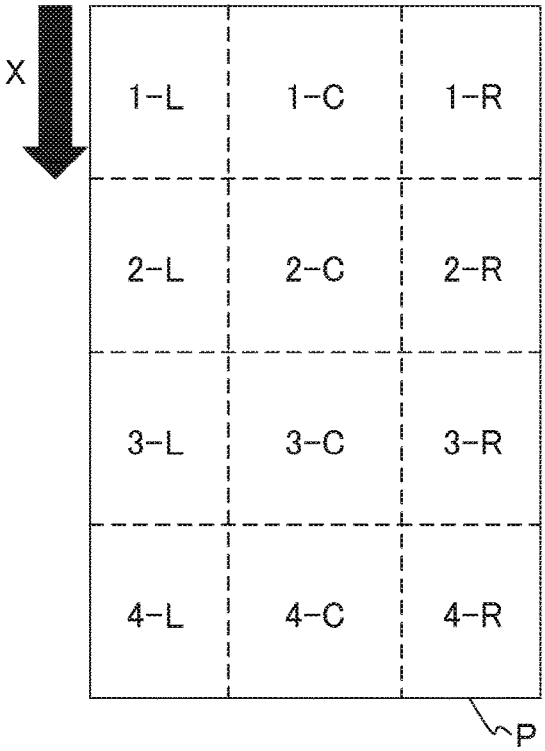
FIG. 7B is a diagram illustrating a region for identifying density of a toner image formed on a sheet according to a third embodiment.

In the present embodiment, as illustrated in FIG. 7B, the control unit 70 divides a sheet into a plurality of regions as indicated by broken lines, and acquires information regarding an image coverage in each region. In the sheet discharge mode, the control unit 70 sets the conveyance speed of the residual sheet based on the distance between a region where the image coverage in the toner image of the residual sheet exceeds the predetermined value and the fixing nip N.

Specifically, the conveyance speed of the residual sheet is set such that the temperature of the fixing device 40 reaches the sheet dischargeable temperature when a region where the image coverage in the toner image of the residual sheet exceeds (is equal to or greater than) the predetermined value reaches the fixing nip N. Specifically, the conveyance speed is made slower in discharging the residual sheet toward the fixing nip N in a case where a distance between the fixing nip N and the region where the image coverage of the toner image of the residual sheet exceeds the predetermined value is a sixth distance shorter than a fifth distance than in a case where the distance between fixing nip N and the region is the fifth distance.

For example, the control unit 70 considers a case where the image coverage information of each of the regions of 1-L, 1-C, and 1-R illustrated in FIG. 7B is all 0% or (less than) a predetermined image coverage or less, and the image coverage of 2-C exceeds the predetermined image coverage. In this case, the conveyance speed of the residual sheet in the sheet discharge mode is set based on the position of 2-C, that is, the position of the distance X from the leading edge of the residual sheet.

According to the present embodiment, the conveyance speed of the residual sheet is set based on the position of the region where the image coverage that may cause fixing failure exceeds the predetermined value. As a result, it is possible to convey the residual sheet at a higher conveyance speed than in a case where the conveyance speed is set such that the temperature of the fixing device 40 reaches the sheet dischargeable temperature when the leading edge of the residual sheet reaches the fixing nip N. Instead of the image coverage, the conveyance speed of the residual sheet may be set based on the distance between the region where the maximum density of the image exceeds the predetermined value and the fixing nip N.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-135963, filed Aug. 11, 2020, which is hereby incorporated by reference herein in its entirety.

What is claimed is:

1. An image forming apparatus comprising:

a conveyor that conveys a sheet and that includes a conveyance path through which the sheet is conveyed;

an image forming unit, including at least one photosensitive drum, that forms an unfixed toner image on the sheet conveyed by the conveyor;

a fixing unit, including a roller, that heats and pressurizes the sheet at a nip portion thereof to fix the toner image formed by the image forming unit to the sheet;

a temperature detecting sensor that detects a temperature of the fixing unit; and a control unit, including a processor, configured to execute a sheet discharge mode of conveying and discharging the sheet to an outside of the apparatus in a state where the sheet is stopped on the conveyance path, wherein, in the sheet discharge mode where the sheet is stopped on the conveyance path, with a leading edge of the sheet positioned between the image forming unit and the nip portion:

in a first state where the leading edge of the sheet and the nip portion are spaced at a first distance; and in a second state where:

the leading edge of the sheet and the nip portion are spaced at a second distance, which is shorter than the first distance, and a detected temperature in the second state is the same as a detected temperature in the first state, the control unit is configured to change the discharge conveyance speed of the sheet in the sheet discharge mode according to the distance between the leading edge of the sheet to be discharged and the nip portion, by setting a slower discharge conveyance speed of the sheet in discharging the sheet toward the nip portion in the second state than that in the first state.

2. The image forming apparatus according to claim 1, wherein, in the sheet discharge mode:

in a third state where the detected temperature is a first temperature, and in a fourth state where:

a distance between the leading edge of the sheet and the nip portion is the same as that in the third state, and the detected temperature is a second temperature, which is lower than the first temperature, the control unit is configured to change the discharge conveyance speed of the sheet in the sheet discharge mode according to the distance between the leading edge of the sheet to be discharged and the nip portion, by setting a slower discharge conveyance speed of the sheet in discharging the sheet toward the nip portion in the fourth state than that in the third state.

3. An image forming apparatus comprising:

a conveyor that conveys a sheet and that includes a conveyance path through which the sheet is conveyed;

an image forming unit, including at least one photosensitive drum, that forms an unfixed toner image on the sheet conveyed by the conveyor;

a fixing unit, including a roller, that heats and pressurizes the sheet at a nip portion thereof to fix the toner image formed by the image forming unit to the sheet;

a temperature detecting sensor that detects a temperature of the fixing unit; and a control unit, including a processor, configured to execute a sheet discharge mode of conveying and discharging the sheet to an outside of the apparatus in a state where the sheet is stopped on the conveyance path, wherein, in the sheet discharge mode where the sheet is stopped on the conveyance path, with a leading edge of the sheet positioned between the image forming unit and the nip portion:

in a first state where the leading edge of the toner image formed on the sheet and the nip portion are spaced at a first distance; and in a second state where:

the leading edge of the toner image formed on the sheet and the nip portion are spaced at a second distance, which is shorter than the first distance, and a detected temperature in the second state is the same as a detected temperature in the first state, the control unit is configured to change the discharge conveyance speed of the sheet in the sheet discharge mode according to the distance between the leading edge of the toner image formed on the sheet to be discharged and the nip portion, by setting a slower discharge conveyance speed of the sheet in discharging the sheet toward the nip portion in the second state than that in the first state.

4. The image forming apparatus according to claim 3, wherein, in the sheet discharge mode:

in a third state where the detected temperature is a first temperature, and in a fourth state where:

a distance between the leading edge of the toner image formed on the sheet and the nip portion is the same as that in the third state, and the detected temperature is a second temperature, which is lower than the first temperature, the control unit is configured to change the discharge conveyance speed of the sheet in the sheet discharge mode according to the distance between the leading edge of the toner image formed on the sheet to be discharged and the nip portion, by setting a slower discharge conveyance speed of the sheet in discharging the sheet toward the nip portion in the fourth state than that in the third state.

5. The image forming apparatus according to claim 3, further comprising:

a sheet detecting sensor that detects the leading edge of the sheet on the conveyance path, wherein the control unit is configured to obtain a position of the leading edge of the toner image formed on the sheet on the conveyance path based on a detection result of the sheet detecting sensor and image information for the image forming unit to form the toner image on the sheet.

6. An image forming apparatus comprising:

a conveyor that conveys a sheet and that includes a conveyance path through which the sheet is conveyed;

an image forming unit, including at least one photosensitive drum, that forms an unfixed toner image on the sheet conveyed by the conveyor;

a fixing unit, including a roller, that heats and pressurizes the sheet at a nip portion thereof to fix the toner image formed by the image forming unit to the sheet;

a temperature detecting sensor that detects a temperature of the fixing unit; and a control unit, including a processor, configured to execute a sheet discharge mode of conveying and discharging the sheet to an outside of the apparatus in a state where the sheet is stopped on the conveyance path, wherein, in the sheet discharge mode where the sheet is stopped on the conveyance path, with a leading edge of the sheet positioned between the image forming unit and the nip portion:

in a first state where a distance between the nip portion and a region where an image coverage of the toner image formed on the sheet exceeds a first distance, and in a second state where the distance between the nip portion and the region where the image coverage of the toner image formed on the sheet exceeds a second distance, which is shorter than the first distance, the control unit is configured to change the discharge conveyance speed of the sheet in the sheet discharge mode according to the distance between the nip portion and the region of the sheet to be discharged, by setting a slower discharge conveyance speed of the sheet in discharging the sheet toward the nip portion in the second state than that in the first state.

7. The image forming apparatus according to claim 6, wherein, in the sheet discharge mode:

in a third state where the detected temperature is a first temperature, and in a fourth state where:

the distance between the nip portion and the region where the image coverage of the toner image formed on the sheet exceeds the first distance is the same as that in the third state, and the detected temperature is a second temperature, which is lower than the first temperature, the control unit is configured to change the discharge conveyance speed of the sheet in the sheet discharge mode according to the distance between the nip portion and the region of the sheet to be discharged, by setting a slower discharge conveyance speed of the sheet in discharging the sheet toward the nip portion in the fourth state than that in the third state.

8. The image forming apparatus according to claim 1, wherein, in the sheet discharge mode, in the first or second state where the leading edge of the sheet is positioned between the image forming unit and the nip portion, the control unit is configured to increase the temperature of the fixing unit for discharging the sheet.

9. The image forming apparatus according to claim 3, wherein, in the sheet discharge mode, in the first or second state where the leading edge of the sheet is positioned between the image forming unit and the nip portion, the control unit is configured to increase the temperature of the fixing unit for discharging the sheet.

10. The image forming apparatus according to claim 6, wherein, in the sheet discharge mode, in the first or second state where the leading edge of the sheet is positioned between the image forming unit and the nip portion, the control unit is configured to increase the temperature of the fixing unit for discharging the sheet.

11. The image forming apparatus according to claim 1, wherein, in the sheet discharge mode, in the first or second state where the leading edge of the sheet is positioned between the image forming unit and the nip portion, the control unit is configured to increase the conveyance speed of the sheet as the leading edge of the sheet reaches the nip portion.

12. The image forming apparatus according to claim 3, wherein, in the sheet discharge mode, in the first or second state where the leading edge of the sheet is positioned between the image forming unit and the nip portion, the control unit is configured to increase the conveyance speed of the sheet as the leading edge of the sheet reaches the nip portion.

13. The image forming apparatus according to claim 6, wherein, in the sheet discharge mode, in first or second state where the leading edge of the sheet is positioned between the image forming unit and the nip portion, the control unit is configured to increase the conveyance speed of the sheet as the leading edge of the sheet reaches the nip portion.

14. The image forming apparatus according to claim 1, further comprising a single motor that drives the conveyor and the fixing unit.

15. The image forming apparatus according to claim 3, further comprising a single motor that drives the conveyor and the fixing unit.

16. The image forming apparatus according to claim 6, further comprising a single motor that drives the conveyor and the fixing unit.

* * * * *